US009427606B2

(12) United States Patent
Ball et al.

(10) Patent No.: US 9,427,606 B2
(45) Date of Patent: Aug. 30, 2016

(54) DESCENT ASSIST DEVICE FOR POWERED ASCENDERS

(71) Applicant: Atlas Devices, LLC, Boston, MA (US)

(72) Inventors: Nathan Ball, Somerville, MA (US); Daniel Walker, Cambridge, MA (US); Benjamin Gallup, Cambridge, MA (US)

(73) Assignee: Atlas Devices, LLC, Boston, MA (US)

( * ) Notice: Subject to any disclaimer, the term of this patent is extended or adjusted under 35 U.S.C. 154(b) by 0 days.

(21) Appl. No.: 14/450,645

(22) Filed: Aug. 4, 2014

(65) Prior Publication Data

US 2015/0034894 A1 Feb. 5, 2015

Related U.S. Application Data

(60) Provisional application No. 61/861,577, filed on Aug. 2, 2013.

(51) Int. Cl.

| | |
|---|---|
| ***B66D 3/08*** | (2006.01) |
| ***A62B 1/06*** | (2006.01) |
| ***B66D 1/74*** | (2006.01) |

(52) U.S. Cl.

CPC ..... *A62B 1/06* (2013.01); *B66D 1/7415* (2013.01); *B66D 1/7447* (2013.01); *B66D 1/7489* (2013.01)

(58) Field of Classification Search

CPC ..... B66C 1/54; B66C 1/7405; B66C 1/7415; B66C 1/7489; B66C 1/7494; B66C 5/16; B66C 5/18; B66C 5/20; B66C 2700/03; A62B 1/06; A62B 1/08; A62B 1/10; A62B 1/14

See application file for complete search history.

(56) References Cited

U.S. PATENT DOCUMENTS

| | | | | |
|---|---|---|---|---|
| 3,078,074 A | | 2/1963 | Benedict | |
| 4,151,980 A | * | 5/1979 | Burton | B66D 1/44 24/132 R |
| 4,603,839 A | * | 8/1986 | Ekman | B66D 1/7415 254/329 |
| 4,774,742 A | | 10/1988 | Johnson | |
| 5,131,491 A | * | 7/1992 | Varner | A62B 1/06 182/7 |
| 5,402,985 A | | 4/1995 | Owens et al. | |
| 5,957,432 A | * | 9/1999 | Ostrobrod | A62B 35/0056 254/368 |
| 6,029,777 A | * | 2/2000 | Rogelja | A62B 1/14 182/192 |
| 6,059,266 A | * | 5/2000 | Ascherin | B64D 1/22 242/397.5 |
| 6,070,858 A | * | 6/2000 | Hase | B66D 1/7415 254/342 |
| 6,283,455 B1 | * | 9/2001 | Ascherin | B64D 1/22 242/397.5 |

(Continued)

FOREIGN PATENT DOCUMENTS

EP 2246100 A1 * 1/2009

OTHER PUBLICATIONS

International Search Report and Written Opinion for Application No. PCT/US2014/049580 mailed Nov. 19, 2014 (11 pages).

*Primary Examiner* — Emmanuel M Marcelo

(74) *Attorney, Agent, or Firm* — Nutter McClennen & Fish LLP

(57) ABSTRACT

A descent assist device for powered ascenders is discussed herein. In one embodiment, the descent assist device can include a base plate having a first guide surface, a capstan peg, a second guide surface, and a retention loop extending from the first guide surface to the second guide surface configured to retain a rope on the descent assist device. Where the angle of wrapping of the rope around the first guide surface and the capstan peg is constant during use and the angle of wrapping of the rope around the second guide surface is adjustable by the user of the device to increase or decrease the frictional drag of the rope.

24 Claims, 8 Drawing Sheets

(56) References Cited

U.S. PATENT DOCUMENTS 6,412,602 B1* 7/2002 Sundman ..... A62B 1/14 182/133
7,261,278 B2 8/2007 Ball et al.
7,448,597 B2 11/2008 Jacobson et al.
7,513,334 B2 4/2009 Calver
7,581,715 B2 9/2009 Ball et al.
7,934,698 B2 5/2011 Ball et al.
8,167,086 B1* 5/2012 Brendley ..... A62B 1/14 182/192
2002/0017428 A1* 2/2002 Mauthner ..... A62B 1/14 182/5
2003/0071252 A1* 4/2003 Halas ..... A01G 23/099 254/334
2006/0017047 A1 1/2006 Calver
2006/0273293 A1* 12/2006 Ball ..... A62B 99/00 254/371
2007/0194290 A1* 8/2007 Fofonoff ..... B66D 1/7415 254/325
2008/0157042 A1 7/2008 Jacobson et al.
2008/0203369 A1* 8/2008 Asmussen ..... B66D 1/7497 254/371
2008/0203370 A1* 8/2008 Ball ..... B66D 1/7415 254/372
2009/0159734 A1* 6/2009 Romo ..... B66B 5/185 242/410
2009/0267038 A1* 10/2009 Teichert ..... B66D 1/38 254/335
2012/0193166 A1* 8/2012 Rogelja ..... A62B 1/14 182/5
2013/0056695 A1* 3/2013 Cazzaro ..... A62B 1/14 254/371
2013/0313047 A1* 11/2013 Chaumontet ..... A62B 1/14 182/241
2014/0190770 A1* 7/2014 Renton ..... A62B 1/10 182/239
2014/0299411 A1* 10/2014 Aldred ..... A62B 1/10 182/5
2014/0318896 A1* 10/2014 Larsson ..... A62B 1/10 182/234

* cited by examiner

DESCENT ASSIST DEVICE FOR POWERED ASCENDERS

CROSS-REFERENCE TO RELATED APPLICATIONS

This application claims benefit under 35 U.S.C. §119(e) of U.S. Provisional Patent Application Ser. No. 61/861,577, filed Aug. 2, 2013, herein expressly incorporated by reference in its entirety.

FIELD OF INVENTION

This invention relates to devices that dissipate gravitational potential energy via friction in devices that travel along ropes. More particularly, the invention relates to a device that improves a powered rope ascender's ability to smoothly descend a rope in a less damaging way while a heavy load is attached to the powered ascender.

BACKGROUND OF THE INVENTION

Powered rope ascenders are gaining use in many industries including industrial access, rescue, and military operations. By using a powered motor attached to a climbing mechanism, they allow users to lift heavy loads along standard lines such as climbing ropes. Powered ascenders are also typically reversible—by reversing the direction of the motor (often after first releasing a safety brake), they can descend lines using the same mechanism as is used to climb. However, the way that powered ascender climbing mechanisms are sometimes constructed can, under some circumstances, impart damage to a rope when the ascender is used to lower a load along a rope. Sometimes a rope will also damage the climbing mechanism.

These drawbacks of using a powered ascender to descend along a rope with a heavy load attached can be magnified when descending along ropes or lines of small diameter. The relatively smaller amount of sheath available covering a 7 mm diameter rope, for instance, will provide reduced protection against the abrasion caused by the climbing mechanism in descent as compared to a larger 11 mm diameter rope whose sheath is proportionally thicker. Much work has gone into climbing mechanisms to increase their efficiency and efficacy while reducing their wear upon the ropes they climb, but fundamentally if they are to function as effectively as they must for climbing purposes, they will provide sub-optimal results when descending, particularly when compared to purpose-built devices for lowering along ropes such as rappelling devices and brake bar racks.

It can therefore be an object of the present invention to provide a device that can be used in conjunction with, or even incorporated into, a powered ascender such that the powered ascender may lower loads along the ropes it climbs and reduce or eliminate the damage the climbing mechanism would otherwise impart on the rope while it descends it. By reducing or eliminating the mechanical wear the ropes experience, the descending device could be said to be assisting the powered ascender in towering or descent, hence the nomenclature "frictional descent assist device."

It can be another object of the present invention to provide a device that provides assisted descending functionality along a range of rope diameters including ones smaller than 6 mm in diameter, larger than 11 mm in diameter, and in between.

Other objects and advantages of the present invention will be apparent to one of ordinary skill in the art in light of the ensuing description of the present invention. One or more of these objectives may include:

(a) to provide a device that can be used in conjunction with or affixed to a powered ascender to improve its ability to descend ropes with minimized or no damage
(b) to provide a device that can assist a powered ascender in lowering a heavy load along a rope with minimized or no damage
(c) to provide a device that can impart a frictional drag or braking force to tensile elongate members such as ropes
(d) to provide a device into which a rope can be installed on a bight, without threading a free end through it
(e) to provide a device whose frictional drag or braking force on ropes can be modulated.

BRIEF SUMMARY OF THE INVENTION

The invention provides a descent assist device that preferably accomplishes one or more of the objects of the invention or solves at least one of the problems described above.

In a first aspect, a powered rope ascender operational in ascending and descending modes is provided. The powered rope ascender includes a reversible drive source and at least rotating rope pulling jaw. The jaw is connected to the reversible drive source so as to be rotated in a first, ascending direction and a second, opposed descending direction. The jaw also has a plurality of forward sweeping rope gripping features when operated in the ascending direction. A friction increasing descent assist device is provided on the powered rope ascender. The friction increasing descent assist device configured to provide a rope path having at least three guide surfaces around which the rope wraps angularly including a first, superior guide surface, a second laterally spaced capstan guide surface, and a third inferior guide surface. The friction increasing descent assist device enhances operation of the powered rope ascender when operating in the descending mode.

In specific embodiments, the friction increasing descent assist device is positioned on the powered rope ascender in an inferior direction from the at least one rope pulling jaw when the powered rope ascender is in use. The first and third guide surfaces may optionally form superior and inferior ends of a retention loop. The retention loop can comprise a gate, allowing a middle portion of rope to be engaged with the friction increasing descent assist device through the gate. The retention loop can optionally ensure that a rope stays engaged within the friction increasing descent assist device regardless of whether a free end of the rope is arranged in an optimal rope entry path while descending. The second guide surface can optionally be provided on a capstan peg that is laterally spaced from the retention loop. The friction increasing descent assist device can optionally be configured to provide a rope path that includes a rope wrap angle around the second guide surface that is greater than 180 degrees. The friction increasing descent assist device can optionally be configured to provide a rope path that includes a rope wrap angle around the second guide surface that is greater than 90 degrees. The friction increasing descent assist device can optionally be configured to provide a sum of rope wrap angles around the guide surfaces that is greater than 360 degrees.

In a second aspect, a device of the invention can include a retention loop through which a bight of rope can be inserted, and a capstan peg around which the bight can be looped.

The device can further include mounting features such as screw holes, bosses, pockets, or ridges that enable it to physically mount onto the body of a powered ascender, such that when it is mounted onto an ascender, it can resist forces imparted upon it during descent by the taut ropes it is descending.

The device can further include one or more rounded surfaces around which the rope is wrapped such that when a tension is imparted to the free end of the rope, by its own weight or otherwise, a magnified tension is produced on the other side of the surface via the capstan effect, and a frictional drag force is imparted on the rope which opposes the direction of motion of the device along the rope.

A device of the invention can be configured as a descent assist device on a powered ascender.

Further aspects of the invention will become clear from the detailed description below.

BRIEF DESCRIPTION OF THE DRAWINGS

The present invention can be more easily understood and better appreciated when taken in conjunction with the accompanying drawings, in which.

DETAILED DESCRIPTION OF THE INVENTION

Figure 1:
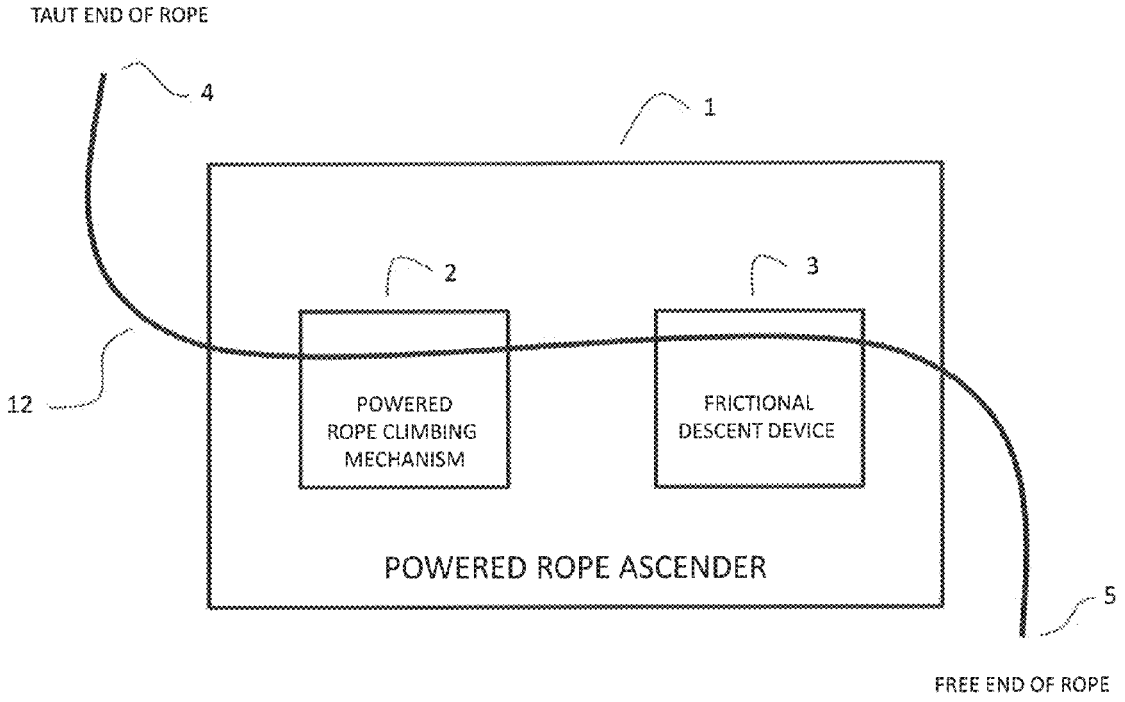
FIG. 1 provides a schematic of the device in a preferred implementation.

Referring now to FIG. 1, a preferred implementation of the device 3 is illustrated diagrammatically. A powered rope ascender 1 which includes a powered rope climbing mechanism 2 is installed on a rope 12 having a taut end 4 and a free end 5. The rope 12 passes through the frictional descent device 3 as well, which is positioned "below" the powered rope climbing mechanism 2 in the chain of components where the taut end of the rope 4 is assumed to be the "top" of the chain. As the rope climbing mechanism 2 advances in the "downward" or inferior direction, rope passes through the powered rope ascender 1 from the free end 5 toward the taut end 4, and the powered ascender 1 lowers itself downward along the rope. When a force is applied to the free end of the rope 5 in the "downward" direction, i.e. in the direction the free end 5 exits the powered rope ascender 1, a magnified frictional drag force is imparted on the rope 12 by the frictional descent device 3 that resists the motion of the device 3 downward along the rope 12. Because the frictional descent device 3 is attached to the powered rope ascender 1, the motion of the powered rope ascender 1 downward along the rope 12 is also resisted.

Figure 2:
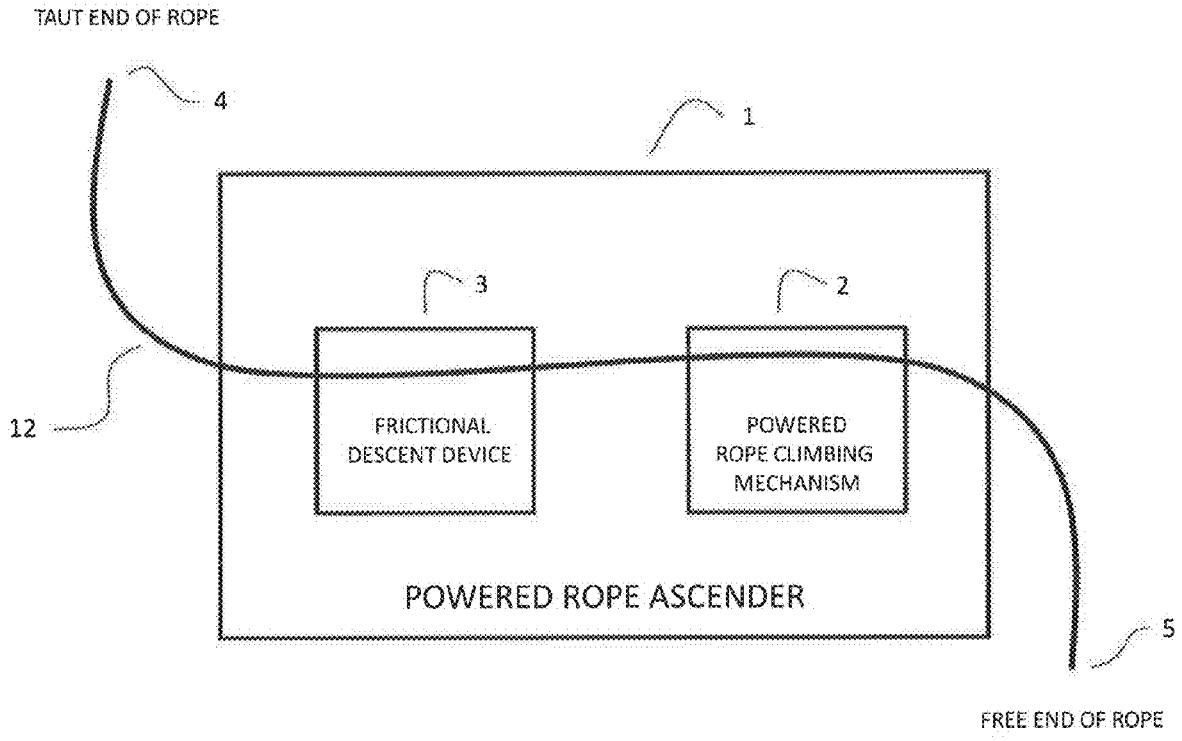
FIG. 2 provides a schematic of the device in an alternative implementation.

An alternative embodiment of the invention is illustrated diagrammatically in FIG. 2, where the frictional descent device 3 is positioned "above" the powered rope climbing device 2 as referenced with the taut end of the rope 4 still being the "top" of the chain of components described herein.

Figure 3:
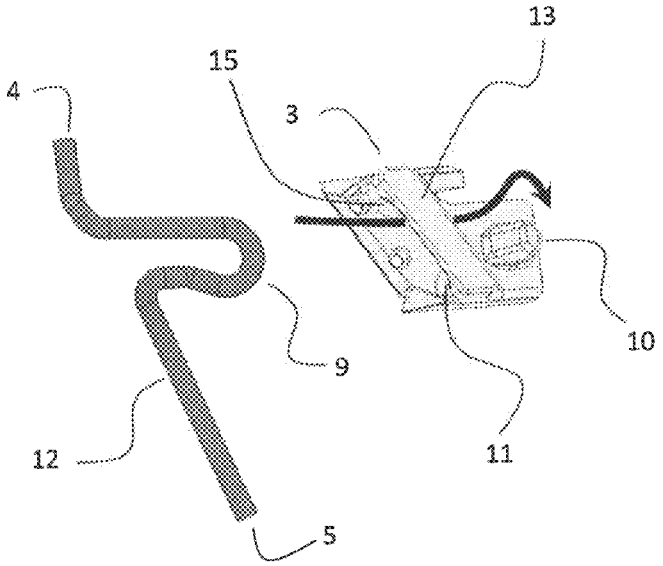
FIG. 3 shows the device with a method for engaging a bight of rope into the device.

FIG. 3 shows a frictional descent device 3 useful with the ascender of FIGS. 1 and 2 next to a rope, with an arrow showing the path of engagement of a bight 9 of the rope 12 passing under the retention loop 13 of the frictional descent device 3. The bight 9 passes under the retention loop 13 and is looped over the capstan peg 10. The retention loop 13 ensures the rope 12 will stay engaged in the device 3 even if the free end of the rope 5 is not arranged to ensure an optimal rope entry path while descending. The guide surface 11 performs a function of magnifying the frictional drag force on the rope subject to the Capstan Equation:

$$T_1 = T_2 e^{(\mu\theta)},$$

where T1 is the tension required on the taut end 5 to pull the rope 12 through the device when T2 is the tension applied to the free end 5 of the rope 12, $\mu$ is the frictional coefficient between the rope 12 and the material of the frictional descent device 3, and $\theta$ is the angle of the wrapping of the rope 12 around the guide surface 11. The same frictional magnification happens as a result of the rope's 12 wrapping around the capstan 10 and any other such guide surfaces which the rope 12 may be wrapped at some angle. A person of ordinary skill in the art will note that if greater frictional drag force is desired from the descent device 3, they may choose to increase the total amount of angular wrap of the rope 12 around guide surfaces 11 or capstan pegs 10 by increasing the number of such features, by configuring the features so as to allow more angular wrap around the same number of features, or by increasing the tension imparted on the free end 5 of the rope 12 as it passes through the device 3.

For example, as illustrated, three guide surfaces are provided. The first guide surface is provided on the superior side 15 of the retention loop 13. The second guide surface is provided on the capstan peg 10. The third guide surface is provided on the inferior side 11 of the retention loop 13. More or fewer guide surfaces could be provided to achieve the desired, or a predetermined, amount of friction for a particular rope. For example, three capstan pegs 10 could be provided, a first superior peg to the right, a second middle peg to the left of the first peg, and a third inferior peg to the right of the second peg. Such a configuration would result in five friction enhancing guide surfaces to which the capstan equation could be applied.

Further, the guide surfaces could be provided on structures other than a retention loop and a capstan peg. In the three guide surface embodiment, three capstan pegs could be used. Still further, a rope guide could be designed with no loops and no capstan pegs, for example by building a groove into the body of the powered rope ascender having the desired number of guide surfaces.

The retention loop 13 essentially forms a rope cover that extends between the superior and inferior guide surfaces. This type of cover provides protection against the rope coming apart from the guide surfaces, while still allowing a bight of rope to be engaged to the friction device without having to feed an end of the rope through the device. A cover could also extend to the capstan peg, providing even more assurance that the rope would not come loose, but making it more difficult to engage the rope with the friction device. Something short of a cover could also be used. For example, a capstan peg or other guide surface could have a lip that helps to retain the rope.

The retention loop can also be gated, or itself be a gate, such that the loop opens for easy engagement of a middle portion or bight of rope, and closes to retain the engaged rope. For example, as illustrated in FIG. 5A, a gate 17 is provided on the retention loop. This gate operates in the manner of a carabiner gate, rotating inward about a hinged end to accept a bight of rope, and closing behind the rope to enclose it.

Figure 4:
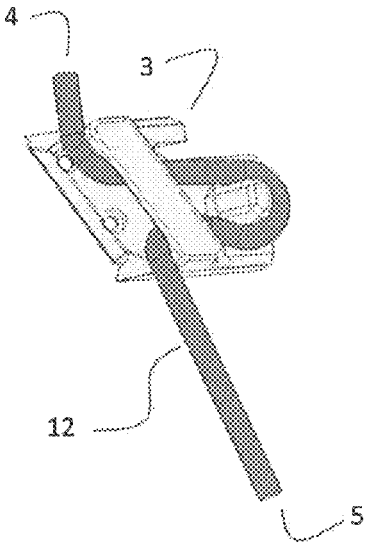
FIG. 4 shows the device with a bight of rope engaged.

FIG. 4 shows the frictional descent device 3 with the rope 12 fully engaged and ready for use.

Figure 5:
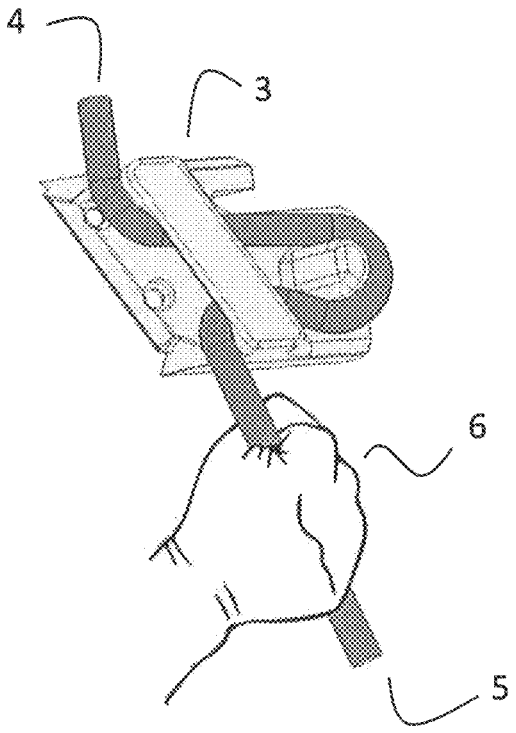
FIG. 5 shows the device with a bight of rope engaged, and a frictional force being applied to the rope by a user's hand.
Figure 5A:
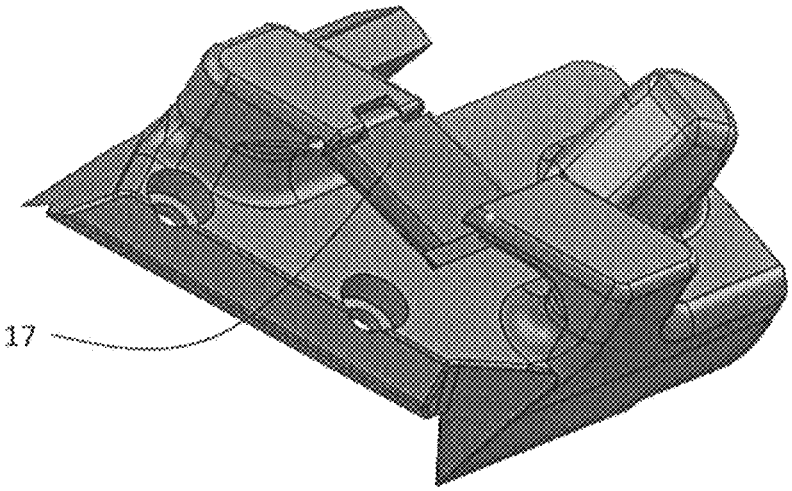
FIG. 5A illustrates a gated retention loop on the device.

FIG. 5 shows the frictional descent device 3 with the rope 12 fully engaged, and with additional tension being supplied to the rope 12 by a user's hand 6 to increase the amount of frictional drag force produced by the descent device 3. The user's hand 6 can modulate the amount of drag force by modulating the amount of tension they impart, which can be useful for controlling the descent speed of a load along the rope 12. Moreover, the user can additionally modulate the wrap angle of the rope 12 around the guide surface 11 providing an additional level of control. The more that the user wraps the rope 12 around the guide surface 11, the greater the frictional magnification The above, and below, embodiments are described with respect to a rope. As used herein, the term "rope" is intended to refer to any flexible, elongate element that has sufficient strength in tension to be able to work with a powered rope ascender.

Figure 6:
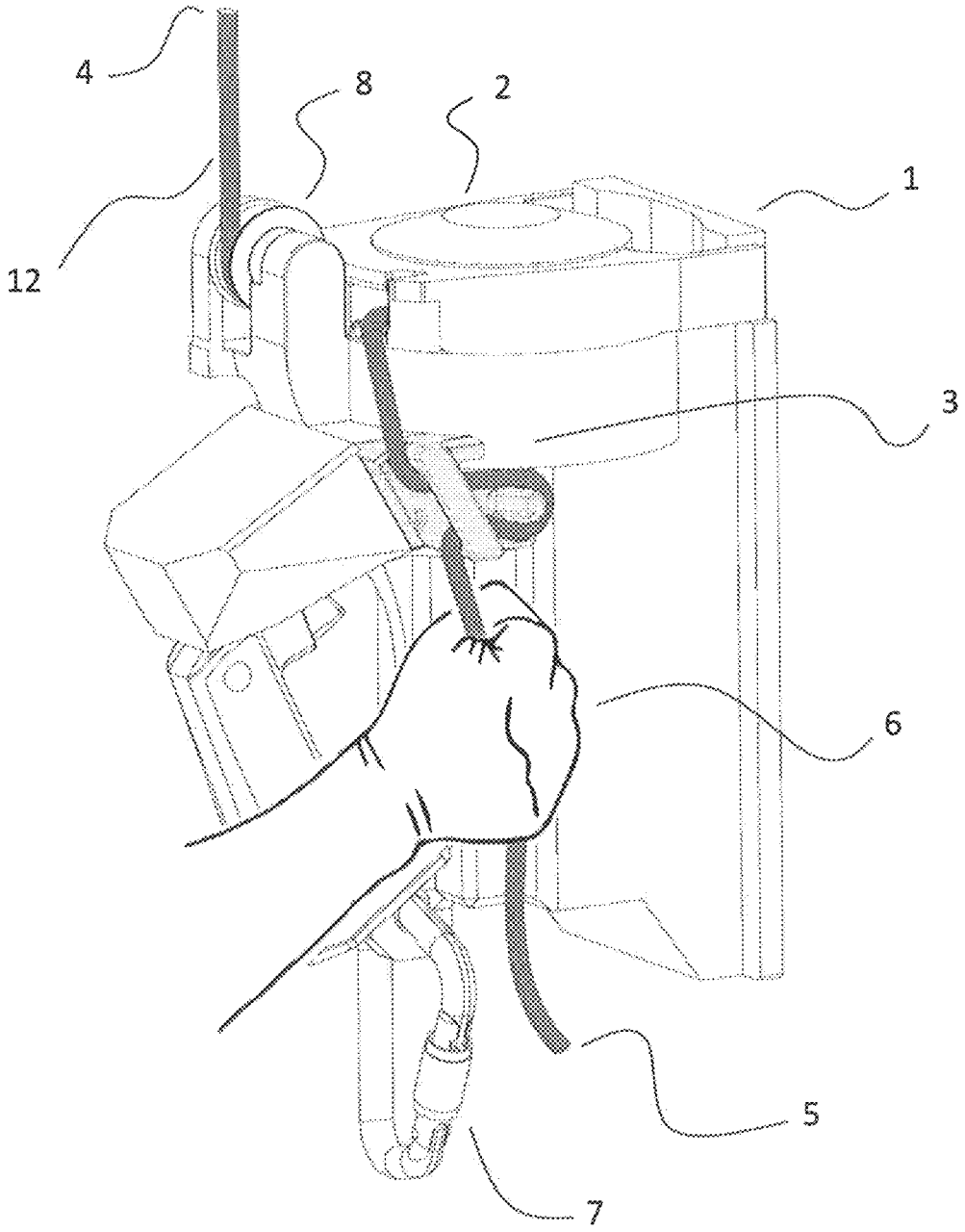
FIG. 6 shows the device installed on a powered rope ascender with a user's hand applying a frictional force to the rope, with the system configured as depicted in FIG. 1.

FIG. 6 shows a powered rope ascender 1 with a frictional descent assist device 3 attached, and with a rope 12 passing from its taut end 4 first through a powered climbing mechanism 2 and then through the frictional descent device 3. A user's hand 6 is shown adding additional tension to the free end 5 of the rope 12, so as to further magnify the drag force produced by the descent device 3, thereby reducing the amount of potential energy which must be dissipated by the rope climbing mechanism 2 and the powered rope ascender 1 while in descending mode. A carabiner 7 is shown attached to the powered rope ascender 1 to aid a reader in envisioning where a load would be attached for lifting or lowering.

A pulley 8 is also shown as part of the powered rope ascender 1. Such a pulley 8 may also be configured to perform the same purpose as the frictional descent device 3. Since the rope 12 is wrapped around the pulley 8 by some angle, if the pulley can be locked by some means to resist rotation when the powered rope ascender 1 is descending the rope 12, it will also impart a frictional drag force on the rope 12 which resists the motion of the powered rope ascender 1 along the rope, thereby acting also as a frictional descent assist device as described herein.

In use, the descent device 3 as described is not needed for climbing, and a user may choose to disengage the rope 12 from the device 3 while climbing to avoid a buildup of slack rope between the climbing mechanism 2 and the descent device 3.

Figure 7:
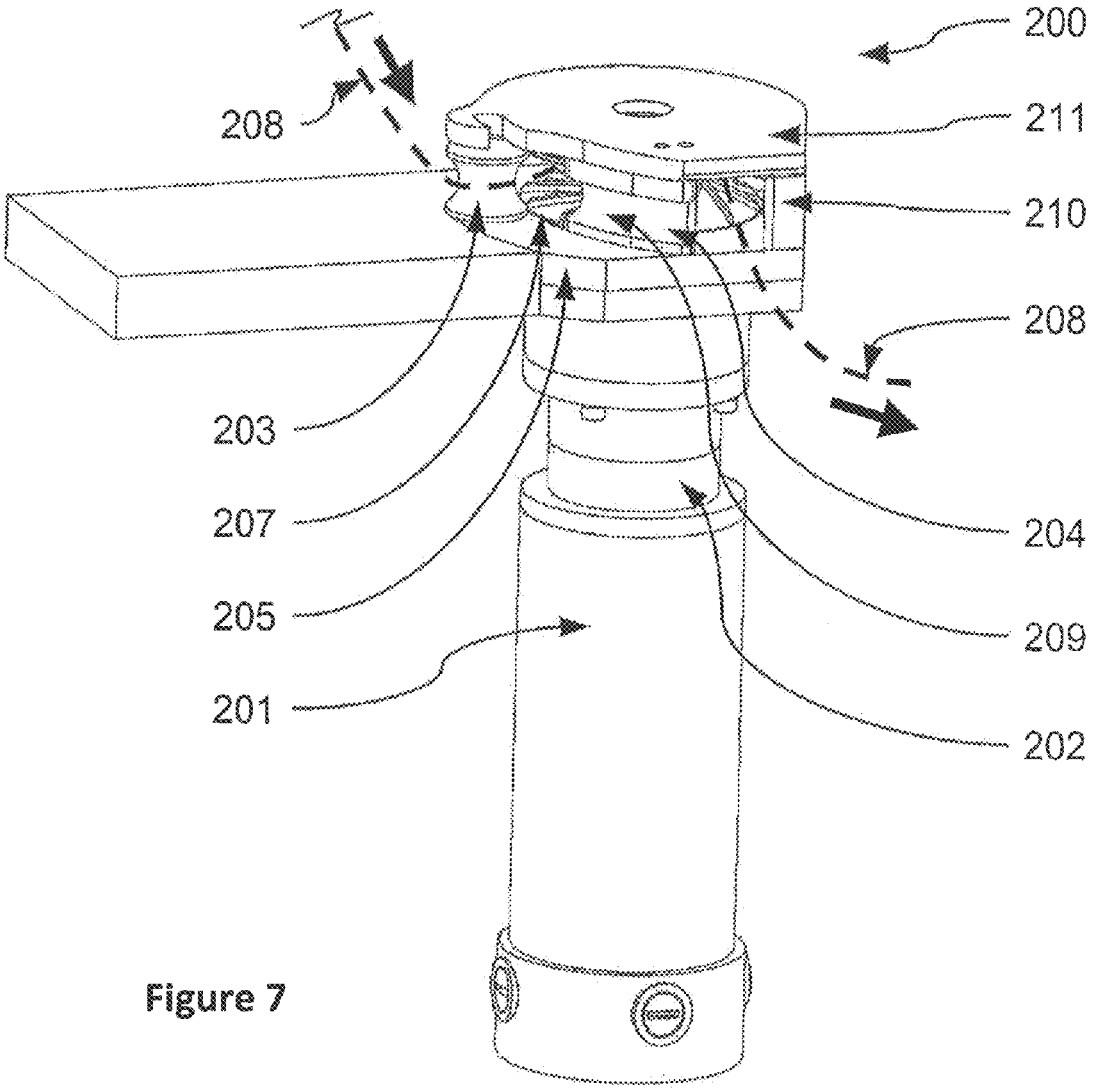
FIG. 7 shows a powered rope ascender which can be used with the system depicted in FIG. 1.
Figure 8:
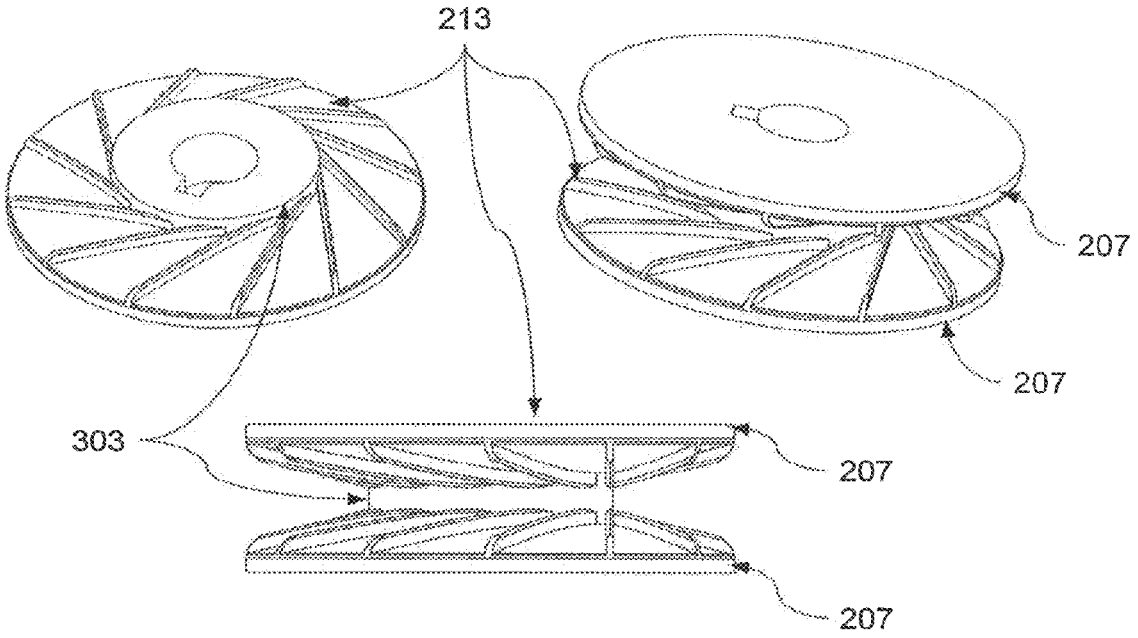
FIG. 8 shows three views of rotating jaws used in the embodiment of FIG. 7.

In one exemplary use, the descent device 3 can be used with the powered rope ascender 200 shown in FIGS. 7 & 8. The powered rope ascender 200 includes a rotational motor 201 from which the pulling motion of the device is derived. A number of different types of motors, such as those discussed above and including two or four stroke internal combustion engines, or ac or dc powered electric motors, could be employed to provide the rotational motion desired for pulling the rope or cable. A motor power source, such as those described above, can also be included that is appropriate to the rotational motor used. These power sources can include gasoline or other petroleum products, a fuel cell, or electrical energy supplied in ac (such as from a power outlet in a typical building) or dc (such as from a battery) form. In the shown preferred embodiment, the rotational motor is a dc electric motor and the motor power source is one or more rechargeable lithium ion batteries. Those skilled in the art will appreciate that various types of motors are within the spirit and scope of the present invention.

The rotational motor 201 can also have speed control and/or a gearbox 202 associated with it to control the speed and torque applied by the rotational motor to the task of pulling a rope. These elements can be integrated into a single, controllable, motor module, be provided as separate modules, or be provided in some combination thereof. In one embodiment, speed control elements can be provided integrally with a dc rotational motor, while a separate, modular gearbox is provided so that the gearing, and thus the speed and torque characteristics of the rope pulling device, can be altered as desired by swapping the gears. A modified self-tailing mechanism 207 is connected to the rotational motor 201, through the gearbox 202. In a preferred embodiment of the invention, the self tailing mechanism 207 includes a pair of rotating self-taller jaws, and the surface of the rotating self-tailor jaws includes ridges oriented in a forward-spiraling fashion so as to engage the rope with increased force and improved efficacy as either the motor torque is increased, or the load on the rope increases. While the illustrated embodiment has two jaws, one jaw could also be employed.

The jaws include ridges 213, splines, or other rope engaging features that are oriented forward toward the direction of rotation (forward sweeping), such that increased back-force on the rope 208 (increased load) or increased torque on the jaws 207 pulls the rope 208 deeper into the V-groove formed by each set of ridges, and thereby the grip force on the rope is increased. In such an embodiment, the jaws 207 and/or ridges 213 can be configured so as to form a barrel having a surface characterized by anisotropic.

The ridges 213 function to maintain the tension on the rope 208 during the ascent due to the forward orientation of the ridges 213. However, when the device 200 is used for powered descent and the jaw rotates in the opposite direction, the rope can temporarily find space between the forward orientation of the ridges 213, potentially resulting in slippage of the rope and damage to the rope by subsequent and repeated re-engagement of the ridges. In use, the descent assist device 3 can be used to obviate, or minimize any slippage during the descent while using a powered descent device 200, or like device.

What is claimed is:

1. A powered rope ascender operational in ascending and descending modes, comprising:

a reversible drive source;

at least one rotating rope pulling jaw, the jaw connected to the reversible drive source so as to be rotated in a first, ascending direction and a second, opposed descending direction, the at least one rotating rope pulling jaw having a plurality of forward sweeping rope gripping features when operated in the ascending direction;

a friction increasing descent assist device configured to provide a rope path having at least three guide surfaces around which a rope disposed in the rope path wraps angularly including a first, superior guide surface, a second laterally spaced capstan guide surface, and a third inferior guide surface, wherein the first and third guide surfaces form superior and inferior ends of a retention loop, and the second guide surface is provided on a capstan peg that is laterally spaced from the retention loop, and wherein the friction increasing descent assist device enhances operation of the powered rope ascender when operating in the descending mode.

2. The powered rope ascender of claim 1, wherein the friction increasing descent assist device is positioned on the powered rope ascender in an inferior direction from the at least one rope pulling jaw when the powered rope ascender is in use.

3. The powered rope ascender of claim 1, wherein the retention loop comprises a gate allowing a middle portion of rope to be engaged with the friction increasing descent assist device through the gate.

4. The powered rope ascender of claim 1, wherein the retention loop ensures that a rope stays engaged within the friction increasing descent assist device regardless of whether a free end of the rope is arranged in an optimal rope entry path while descending.

5. The powered rope ascender of claim 1, wherein the rope path provided for by the friction increasing descent assist device includes a rope wrap angle around the second guide surface that is greater than 90 degrees.

6. The powered rope ascender of claim 5, wherein the rope wrap angle of the rope path is greater than 180 degrees.

7. The powered rope ascender of claim 5, wherein the friction increasing descent assist device is configured to provide a sum of rope wrap angles around the guide surfaces that is greater than 360 degrees.

8. The powered rope ascender of claim 1, wherein the friction increasing descent assist device enhances the operation of the powered rope ascender by reducing an amount of damage caused to a rope disposed in the rope path by the forward sweeping rope gripping features when operated in the descending direction.

9. The powered rope ascender of claim 8, further comprising a rope disposed in the rope path, engaged to the powered rope ascender and the friction increasing descent assist device, the rope having a diameter of 7 mm or less.

10. The powered rope ascender of claim 1, wherein the friction increasing descent assist device enhances the operation of the powered rope ascender by slowing the rate of descent when a rope disposed in the rope path is located between the forward sweeping rope gripping features when operated in the descending direction.

11. The powered rope ascender of claim 10, further comprising a rope engaged to the powered rope ascender and the friction increasing descent assist device, the rope having a diameter of 7 mm or less.

12. A descent assist device for use with a powered ascender comprising:

a rope;

a base plate;

a first guide surface located on a superior portion of the base plate;

a capstan peg laterally spaced from the first guide surface on the base plate, the capstan peg including a second guide surface;

a third guide surface located on the base plate in an inferior direction from the first guide surface; and a retention loop extending from the first guide surface to the third guide surface and substantially fixed with respect to the base plate, the retention loop being configured to retain the rope on the descent assist device;

wherein an angle of wrapping of the rope around the first guide surface and the second guide surface is constant during use and the angle of wrapping of the rope around the third guide surface is adjustable by the user of the device to increase or decrease the frictional drag of the rope.

13. The descent assist device of claim 12, wherein the angle of wrap of the rope around the first guide surface is approximately 90°, the angle of wrap of the rope around the second guide surface is greater than 180° and the angle of wrap around the third guide surface is at least 90°.

14. The descent assist device of claim 12, wherein when the descent assist device is used with a powered ascender descending the rope, the rope is wrapped around the first guide surface, the second guide surface, and the third guide surface.

15. The descent assist device of claim 14, wherein when the descent assist device is used with the powered ascender ascending the rope, the rope is disengaged from the descent assist device.

16. The descent assist device of claim 12 wherein the descent assist device is configured to prevent rope slippage when the powered ascender is used to descend the rope.

17. The descent assist device of claim 12, wherein the retention loop comprises a gate allowing a middle portion of the rope to be engaged with the descent assist device through the gate.

18. A descent assist device for use with a powered ascender comprising:

a rope;

a base plate;

a first guide surface located on a superior portion of the base plate;

a capstan peg laterally spaced from the first guide surface on the base plate, the capstan peg including a second guide surface;

a third guide surface located on the base plate in an inferior direction from the first guide surface; and a retention loop having a first end and a second, opposed end that are each coupled to the base plate, the retention loop being configured to retain the rope on the descent assist device, wherein an angle of wrapping of the rope around the first guide surface and the second guide surface is constant during use and the angle of wrapping of the rope around the third guide surface is adjustable by the user of the device to increase or decrease the frictional drag of the rope.

19. The descent assist device of claim 18, wherein the retention loop extends from the first guide surface to the third guide surface.

20. The decent assist device of claim 18, wherein the angle of wrap of the rope around the first guide surface is approximately 90°, the angle of wrap of the rope around the second guide surface is greater than 180° and the angle of wrap around the third guide surface is at least 90°.

21. The descent assist device of claim 18, wherein when the descent assist device is used with a powered ascender descending the rope, the rope is wrapped around the first guide surface, the second guide surface, and the third guide surface.

22. The descent assist device of claim 21, wherein when the descent assist device is used with the powered ascender ascending the rope, the rope is disengaged from the descent assist device.

23. The descent assist device of claim 18 wherein the descent assist device is configured to prevent rope slippage when the powered ascender is used to descend the rope.

24. The descent assist device of claim 18, wherein the retention loop comprises a gate allowing a middle portion of the rope to be engaged with the descent assist device through the gate.

* * * * *